United States Patent [19]

Glendinning

[11] Patent Number: 4,824,058

[45] Date of Patent: Apr. 25, 1989

[54] TABLE BASE

[76] Inventor: Scott Glendinning, 5515 Doyle St. #2, Emeryville, Calif. 94608

[21] Appl. No.: 132,217

[22] Filed: Dec. 14, 1987

[51] Int. Cl.[4] ..... F16M 11/32

[52] U.S. Cl. ..... 248/164; 248/188.1

[58] Field of Search ..... 248/165, 188.1, 164; 108/157, 153, 111, 161; 211/148, 177, 182; 182/151, 179; 52/263

[56] References Cited

U.S. PATENT DOCUMENTS

| | | | |
|---|---|---|---|
| 402,709 | 5/1889 | Abbott | 108/157 |
| 1,977,848 | 10/1934 | Gwynn | 108/157 |
| 2,271,496 | 1/1942 | Hofman | 248/188.1 |
| 2,759,780 | 8/1956 | Barker | 108/157 |
| 3,074,771 | 1/1963 | Wilson | 108/157 X |
| 3,396,933 | 8/1968 | Ward | 248/165 X |
| 3,731,639 | 5/1973 | Schiemann | 108/157 |
| 3,940,100 | 2/1976 | Haug | 248/188.1 |
| 4,440,812 | 4/1984 | Norrid | 248/165 X |
| 4,717,108 | 1/1988 | Liedle | 248/164 X |

FOREIGN PATENT DOCUMENTS

| | | | |
|---|---|---|---|
| 535386 | 2/1955 | Belgium | 108/157 |

*Primary Examiner*—J. Franklin Foss

*Attorney, Agent, or Firm*—Bielen & Peterson

[57] ABSTRACT

A universal support member for a platform which utilizes an elongated member extending along an axis having a selected length. The elongated member includes a thickness dimension along the axis. A pair of slots are also constructed in the elongated member. Each slot includes a floor and a wall portion. The transverse dimension across the floor of each slot is equal to the thickness dimension of the elongated member. The centers of each of the floors of the slots lie equidistant from the center of the axis.

7 Claims, 4 Drawing Sheets

FIG-3
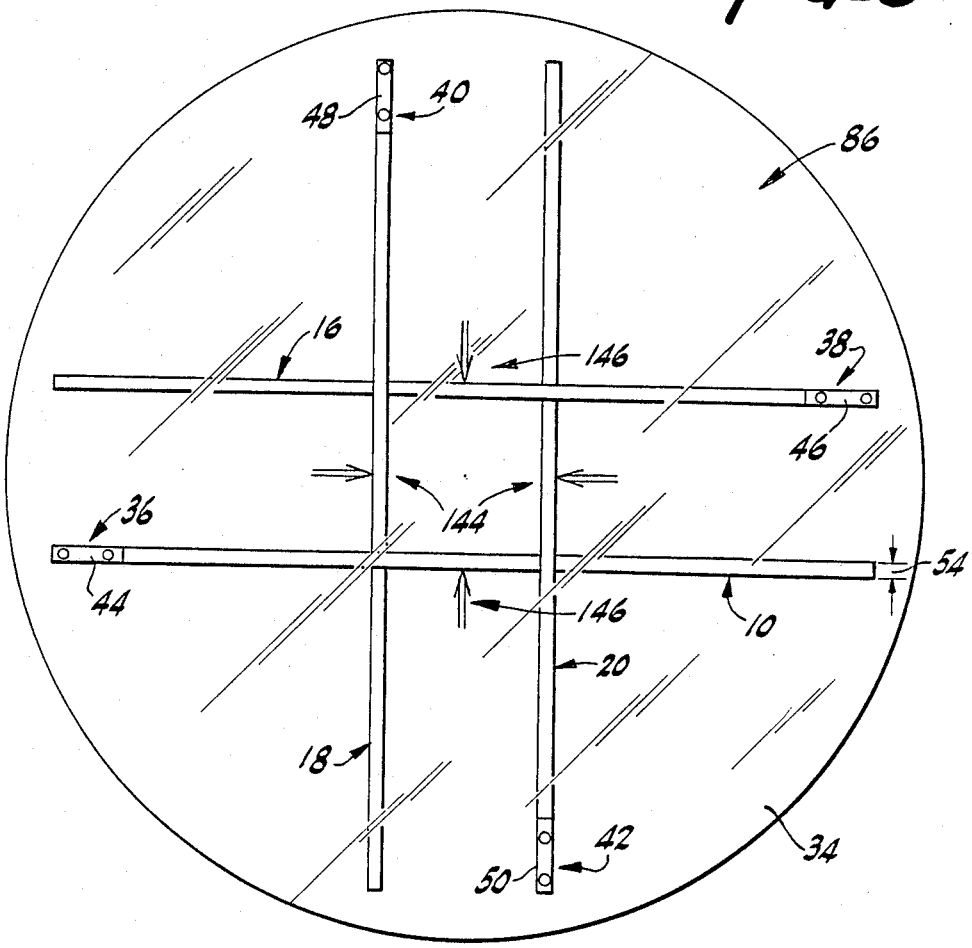
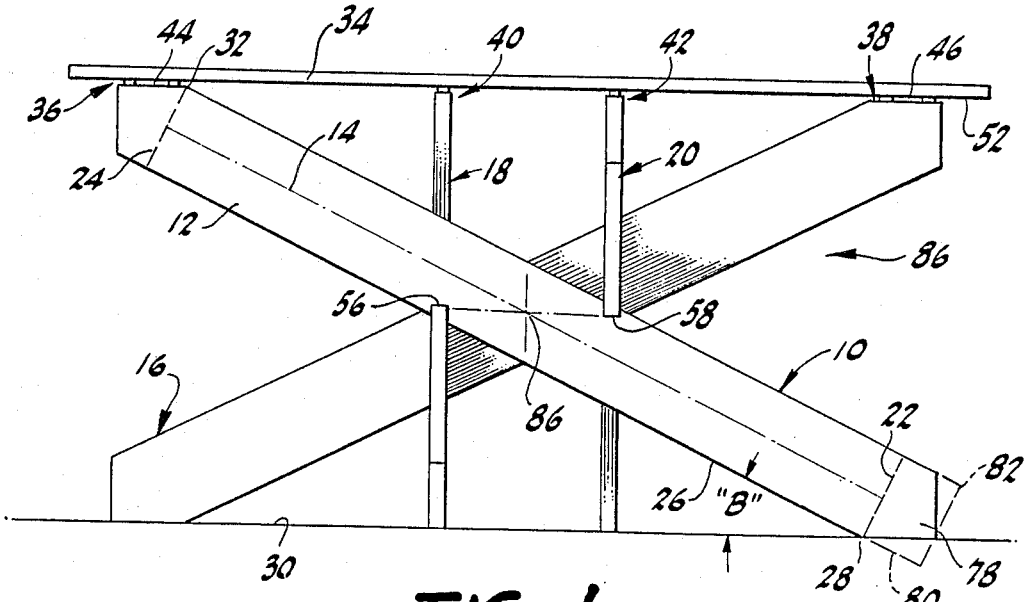
FIG-1

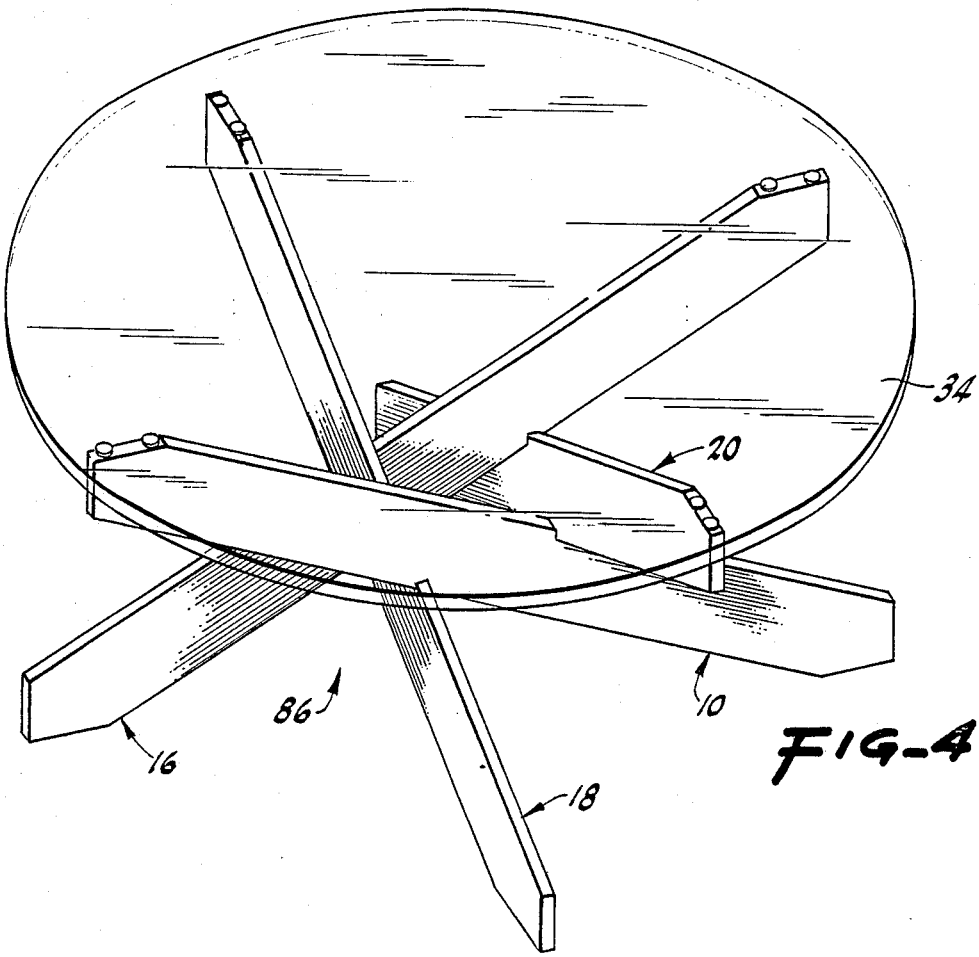
FIG-4
FIG-2A
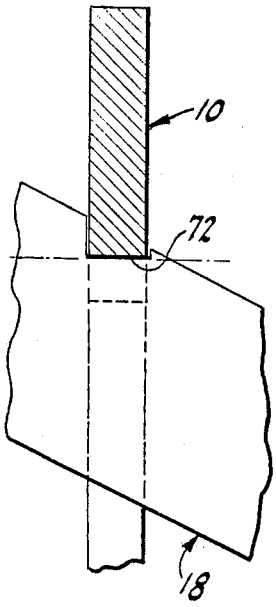
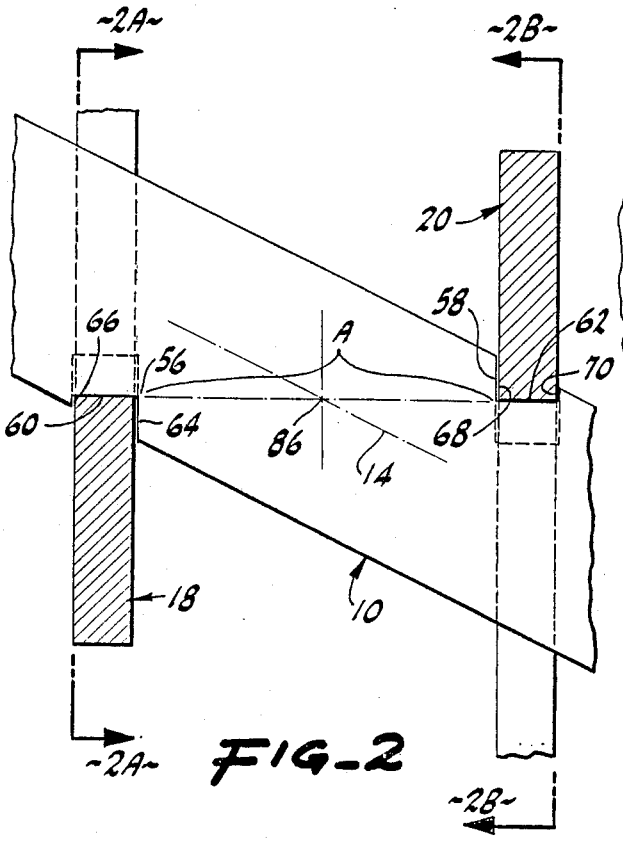
FIG-2
FIG-2B
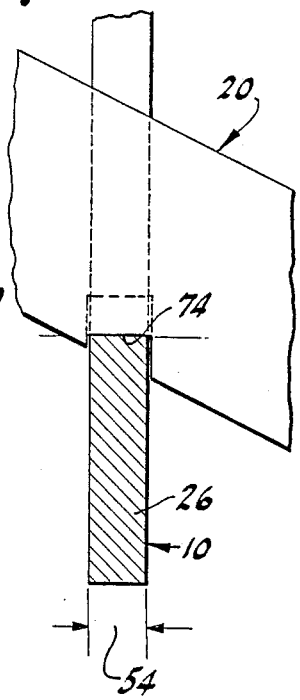

TABLE BASE

BACKGROUND OF THE INVENTION

The present relates to a novel universal support member for a platform or a table.

Collapsible furniture possess the advantage of being easy to store and transport. However, furniture of this type in the past have been complicated to manufacture and assemble. In addition, the constant opening and closing of such furniture requires moving parts which eventually fail. Collapsible furniture has also attained the reputation for being flimsy or rickety.

A support for a table or platform which overcomes the disadvantages of the prior art would be a great advance in the field of furniture and furnishings.

SUMMARY OF THE INVENTION

In accordance with the present invention a novel and useful universal support member capable of being assembled with like members into a base for a platform is provided.

The universal support structure of the present invention includes a elongated member which extends along an axis of a selected length. The elongated member possesses a thickness dimension along such an axis. A pair of slots is included in the elongated member, each slot having a floor in a wall portion. The transverse distance along the floor is at least equal to the thickness dimension of the elongated member. The slot may include a second wall portion spaced from and facing the first wall portion in such a construction. The first and second wall portions mark the boundary of the floor of the slot.

The centers of the floors of the first and second slots lie equidistant from the center of the axis. Each pair of slots is substantially identical, dimensionally, to each other.

The support member may also be provided with first and second end portions each having a surface substantially parallel to one another. Where the surfaces are flat and the floors of the first and second slots are substantially flat, the flat surfaces of the first and second end portions lie substantially parallel to the floors of the first and second slots.

Thus, the universal support structure hereinbefore described, may be interchangeably assembled to form a base for a table top or platform.

It may be apparent that a novel and useful universal support structure has been described.

It is therefore an object of the present invention to provide a universal support structure which may be detachably assembled into a base for a table which is extremely strong and stable.

It is another object of the present invention to provide a support structure which may be assembled into a table base while using a plurality of such support structures, such base having an esthetic appeal.

Another object of the present invention is to provide an universal support structure which may be assembled into a base for a table having various heights above a floor by changing parameters for location of pairs of notches in the universal support structure.

A further object of the present invention is to provide a universal support structure which may assembled into a base for a table or platform which is very easily moved without disassembly.

The invention possesses other objects and advantages especially as concerns particular characteristics and features thereof which may become apparent as the specification continues.

BRIEF DESCRIPTION OF THE DRAWINGS

FIG. 1 is a side elevational view of a base utilizing the universal support structure of the present invention.

FIG. 2 is partial sectional view showing the slot relationship of the universal support structure in its assembled condition.

FIG. 2*a* is a sectional view taken along line 2*a*—2*a* of FIG. 2.

FIG. 2*b* is a sectional view taken along line 2*b*—2*b* of FIG. 2.

FIG. 3 is a top plan view of a table base utilizing a quartet of universal support structures.

FIG. 4 is a top right perspective view of a table base using a quartet of universal support structures.

Figure 5:
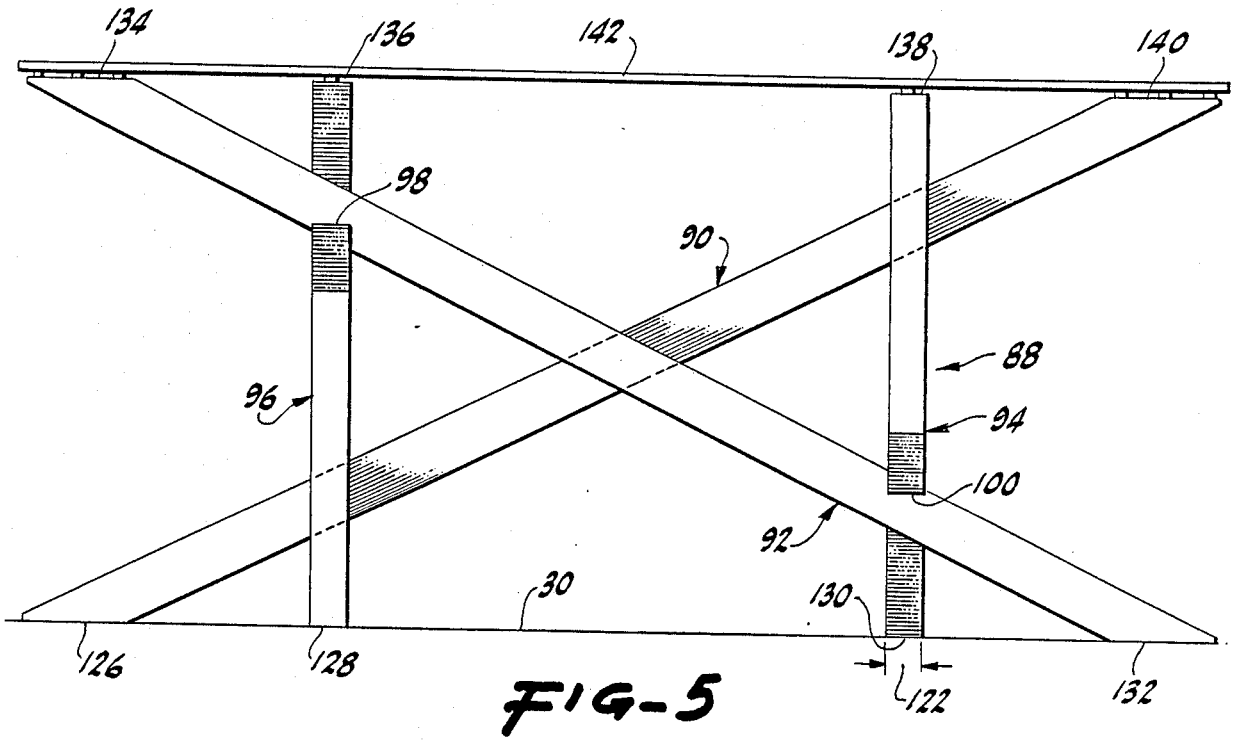
FIG. 5 is a side elevation view of an alternate embodiment of a table base using dissimilar pairs of support members.

For a better understanding of the invention reference is made to the following detailed description of the preferred embodiments thereof which should be referenced to the hereinabove described drawings.

DESCRIPTION OF THE PREFERRED EMBODIMENTS

Various aspects of the present invention will evolve from the following detailed description of the preferred embodiments thereof which should be referenced to the hereinabove described drawings.

The invention as a whole is shown in the drawings by referenced character 10, FIG. 1. The universal support 10 includes an elongated element 12 which extends along axis 14. Support structure 10 is substantially identical to support structures 16, 18, and 20 as shown in FIG. 1. Thus, any description regarding support structure 10 also applies to support structures 16, 18, and 20.

Axis 14 of the elongated member 12 possesses a definite length defined by lines 22 and 24. Lines 22 and 24 are perpendicular to edge portion 26 which extends around the circumference of member 12. Line 22 begins at reference place 28 where elongated member 12 touches ground surface 30 and flat surface 78 begins. Likewise, line 24 extends from reference place 32 which lies parallel to transparent table top 34 and marks the beginning of flat surface 44. It should be noted that pairs of rounded cushions 36, 38, 40, and 42 separate flat surface 44, 46, 48, and 50 of structures 10, 16, 18, and 20 from table top 34. In the absence of pairs of circular cushions 36, 38, 40, and 42, flat surfaces 44, 46, 48, and 50 of the respective structures would contact the under surface 52 of transparent table top 34. In this case, reference place 32 would be defined by such a contact.

Figure 7:
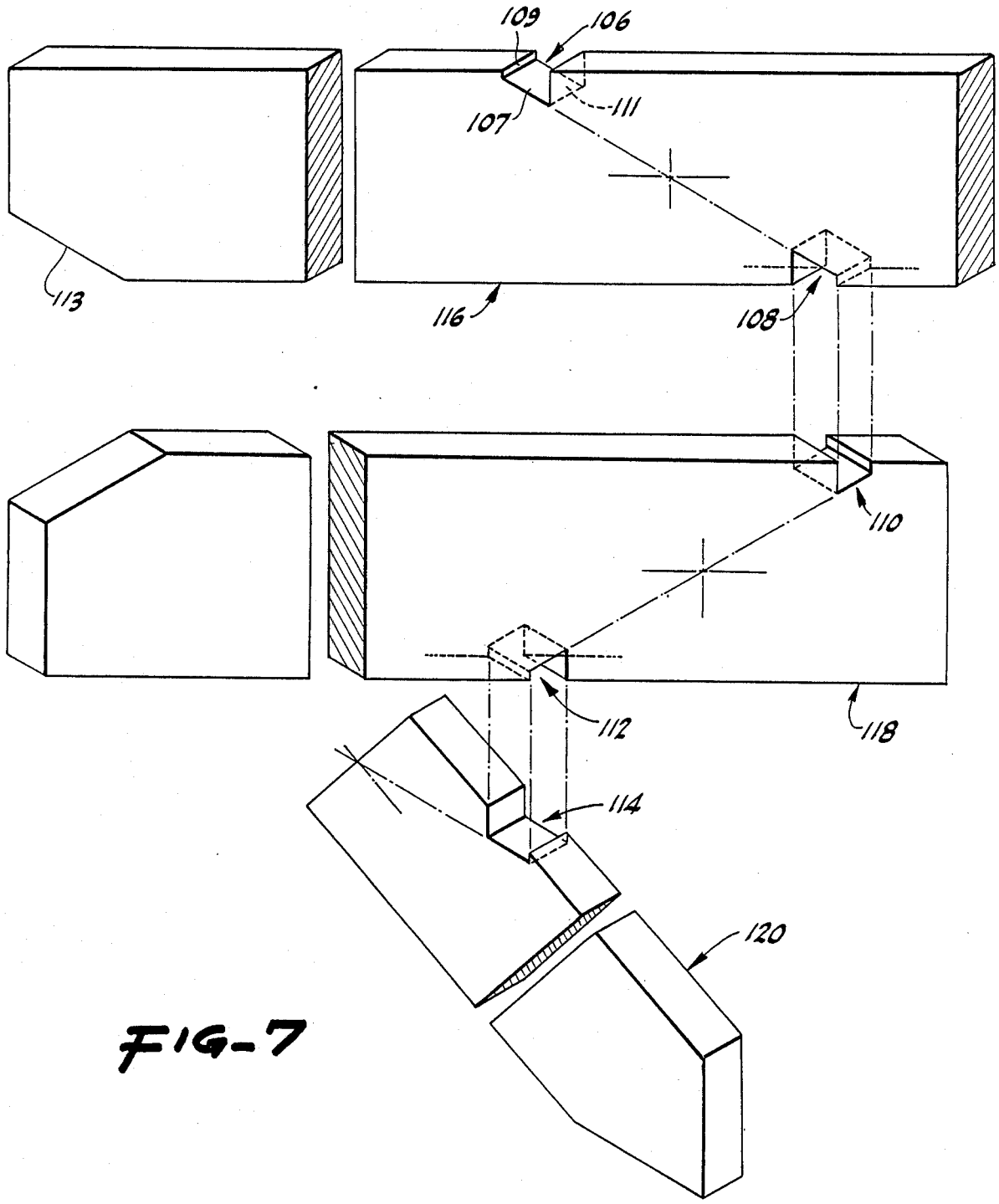
FIG. 7 is a perspective view showing the interlocking of three support structures each having at least one identically dimensioned slot.

Returning to exemplar structure 10, edge portion 26 possesses a thickness dimension 54, FIG. 3. In the embodiment shown in FIGS. 1–4 and 7 such thickness is uniform along edge portion 26 of structure 10. Structure 10 includes slots 56 and 58, best shown in FIG. 2. Slots 56 and 58 are substantially identical, each having a floor 60 and 62 which is at least equal to the thickness of dimension 54 of edge portion 26. In the preferred embodiment, the width or transverse dimension of floor 60 is one sixtyfourth of an inch larger than the thickness dimension 54 thereof. Slots 60 and 62 include pairs of wall portions 64 and 66, as well as wall portions 68 and 70, respectively. FIGS. 2A and 2B also depicts slots 72 and 74 of structures 18 and 20, such slot having a structure substantially identical to slots 60 and 82. FIG. 7, which will be discussed in detail hereafter, depicts the structure of slots 60, 62, 72 and 74.

With reference again to FIG. 1 it may be observed that universal structure 10 includes a flat surface 78 which rest on ground surface 30. Removed portions 80 and 82 indicate the original configuration of elongated member 12, which is preferably aluminum stock. Of course, removed portions 80 and 82 represent the original configuration of both ends of structures 10, 16, 18, and 20. It should also be noted that each structure 10, 16, 18 and 20 includes a flat bottom surface such as surface 78 of structure 10, for contacting ground surface 30.

Slots 56 and 58 of the elongated member 12 lie equidistance from the center 86 of axis 14. Flat surfaces 44 and 78 of structure 10 are parallel to floors 60 and 62 of slots 56 and 58, respectively. The assembled condition of structures 10, 16, 18, and 20 into a table base 86 is illustrated in FIGS. 1, 3, and 4. In certain cases, increasing the distance between axis center 86 and each slot 56 and 58, decreases the height of base 86 above ground surface 30 and vice versa. In the embodiment shown in FIGS. 1–4, the distance "A" between slot walls 64 and 68 is 7.074 inches for 4"×¾" aluminum bar stock, resulting a platform 84 height of about 16 inches. Decreasing distance "A" to 5.55 inches, and maintaining slot and end portion surface parallelism, increases platform 86 height to about 28"where axis 14 is approximately 46 inches in length, for 4"×¾" aluminum bar stock. The angle "B" between structure 10 and ground surface 30 is about 26° in the former case and 32° in the latter case. Of course, the distance between exemplar slot walls 64 and 68 will decrease with an increase of the width of slots 56 and 58.

Figure 6:
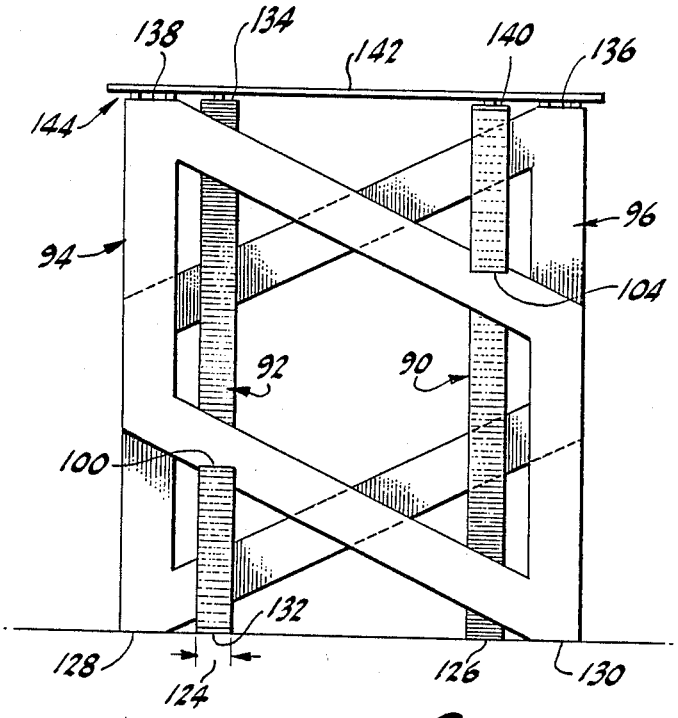
FIG. 6 is a end view of the table base depicted in FIG. 5.

With reference to FIGS. 5 and 6, another embodiment of the present invention is depicted where a table or platform base 88 includes substantially identical members 90 and 92 and substantially identical members 94 and 96. Members 90 and 92 are elongated while members 94 and 96 possess a trapezoidal configuration. Exemplar elongated member 92 includes slots 98 and 100. Exemplar trapezoidal member 94 also includes slots 102 and 104. Slots 96, 98, 100, and 102 have the same configuration as the slots associated with structures 10, 16, 18, and 20. That is to say, each slot associated with members 90, 92, 94, and 96, FIGS. 5 and 6, possess a substantially identical structure. Thus, the thickness dimension 22 of members 94 and 96, as well as the thickness dimension 124 associated with elongated members 90 and 92 substantially equal each other and are equal to or less than the width of any slots associated with the elongated members 90 and 92 and trapezoidal members 94 and 96. The flattened bottom portions 126, 128, 130 and 132 of members 90, 96, 94, and 92, respectively, obtain support from ground surface 30. Similarly, flattened upper portions 134, 136, 138, and 140 of members 92, 96, 90 and 94 provide support to platform or top 142 via plurality of rounded cushions 144. As in the embodiments shown in FIGS. 1–4, flattened upper portions 134, 136, 138, and 140 and flattened bottom portions 126, 128, 130, and 132 are substantially parallel to the floors of the slots associated with members 90, 92, 94, and 96.

With reference to FIG. 7, slots 106, 108, 110, 112, and 114 are depicted as having a substantially identical surface in association with members or structures 116, 118, and 120. It should be understood that slots depicted in FIG. 7 are substantially similar to the slots depicted in FIGS. 1–6 employed in the platform bases 86 and 88 in conjunction with structures 10, 16, 18, and 20 and members 90, 92, 94, and 96.

For example, slot 106 includes a floor 107 and wall portions 109 and 111. Floor 107 is substantially parallel to flat surfact 113, which corresponds to the end flat surfaces of structures 10, 16, 18, and 20, and members 90, 92, 94, and 96 eg: flat surfaces 44 and 78 of structure 10. Exemplar wall portion 109 is intended to prevent slippage between interlocking members 116 and 118.

In operation, the user employs universal structure 10 in the embodiments shown in FIG. 4 in conjunction with substantially with identical structure 16, 18, and 20. The slots on such structures interlock to provide a table base 86 as shown in FIG. 4. It may be obvious that any one of the structures shown in FIG. 4 may be interchanged. Addition, in the absence of rounded cushions 36, 38, 40 and 42, the platform base 86 may be turned upside down to support transparent table top 34. The weight of table top 34 aids in the stability of base 86. However, the removal of top 34 permits the user to very simply disassemble base 86 by removing each structure from each interlocking slot. Base 86 is easily moved along ground surface 30 by applying pressure along pairs of directional arrows 144 or 146. With reference to the embodiment shown in FIGS. 5 and 6, trapezoidal members 94 and 96 are spaced from each other and connected by interlocking elongated members 90 and 92 as shown in FIGS. 5 and 6. The platform or table top 142 aids in the stability of platform base 88 which is easily disassembled after removal of top 142.

While in the foregoing embodiments of the present invention have been set forth in considerable detail for the purpose of making a complete disclosure of the invention, it may be apparent to those of skill in the art that numerous changes may be made in such details without departing from the spirit and principles of the invention.

What is claimed is:

1. A universal support structure capable of being assembled with like structures to form a base for a platform, comprising:

an elongated member extending along an axis having a selected length and including a transverse thickness dimension along said axis; said elongated member including first and second opposite edge portions extending along said axis;

said member including a first slot having a floor and one flat wall portion, the transverse distance along said floor being at least equal to said transverse thickness dimension of said elongated member, said first slot being open toward said first edge portion of said elongated member, said one flat wall portion of said first being substantially perpendicular to said axis;

said elongated member including a second slot having a floor and one flat wall portion, the traverse distance along said floor being at last equal to said thickness dimension of said elongated member, said second slot being open toward said opposite second edge portion of said elongated member said one flat wall portion of said second slot being substantially perpendicular to said axis; and, said center of said floors of said first and second slots lying equidistance from the center of said axis, said floor of said first slot being substantially identical, dimensionally, to said floor of said second slot.

2. The universal support structure of claim 1 in which said elongated member includes a first end portion and a second end portion, said first and second end portions each including a surface substantially parallel to one another.

3. The universal support structure of claim 2 in which said end portion surfaces of said first and second member are substantially flat and said floors of said first and second slots are substantially flat, said flat surfaces of said first and second end portion surfaces lying substantially parallel to said floors of said first and second slots.

4. The universal support structure of claim 1 in which each of said first and second slots further comprises another wall spaced from and facing said one wall, one and another wall portions marking the boundary of said floor.

5. A support structure for a platform including:

a. a pair of support members each possessing two pairs of parallel legs and each having a trapezoidal configuration, each leg of one of said pairs of parallel legs including a slot having a floor and one wall portion, said floors of each slot being parallel to one another;

b. a pair of elongated members each including a pair of slots, each slot having a floor and one wall portion said floors of each slot of said pair of elongated members being substantially parallel to one another and being parallel to said slots of said pair of trapezoidal support members, said pair of trapezoidal support members and said pair of elongated members and said pair of elongated members each possessing a substantially equal thickness dimension, each of said slots of said pair of trapezoidal support members and said elongated members having a transverse distance along said floor being at least equal to said substantially equal thickness dimension; said pair of trapezoidal support members and said pair of elongated members being capable of being assemblage into a support for a platform.

6. The support structure of claim 5 in which each of said pair of trapezoidal support members and each of said elongated members possess a pair of flattened end surfaces, one being capable of obtaining support from a ground surface and another being capable of supporting the platform.

7. The support structure of claim 6 in which each of said one and another flattened end surfaces are substantially parallel to each of said slot floors of said pair of trapezoidal support members and said elongated members.

* * * * *